United States Patent [19]

Arnaud Malavard

[11] 4,126,096

[45] Nov. 21, 1978

[54] SYSTEM OF SUPPORT LEGS FOR A TABLE, A SEAT OR LIKE OBJECT RESTING UPON THE FLOOR BY MEANS OF A SET OF LEGS

[76] Inventor: Yvette J. D. Arnaud Malavard, 25, Ave. Ferdinand Buisson, 75016 Paris, France

[21] Appl. No.: 744,266

[22] Filed: Nov. 23, 1976

[51] Int. Cl.[2] ..... A47B 9/00

[52] U.S. Cl. ..... 108/145; 74/417; 248/421

[58] Field of Search ..... 108/116, 145, 147; 248/188.2, 421; 74/417, 424.8

[56] References Cited

U.S. PATENT DOCUMENTS

| | | | |
|---|---|---|---|
| 269,264 | 12/1882 | Cloyd | 74/417 X |
| 326,326 | 9/1885 | Perry | 108/116 |
| 458,847 | 9/1891 | Hooker et al. | 108/147 X |
| 797,077 | 8/1905 | Shaw | 248/421 X |
| 896,382 | 8/1908 | Hanson | 108/147 |
| 2,902,701 | 9/1959 | Driskill | 5/64 X |
| 3,137,525 | 6/1964 | Purser, Jr. | 108/145 X |
| 3,305,876 | 2/1967 | Hutt | 108/147 X |
| 3,443,850 | 5/1969 | Scime et al. | 108/147 X |
| 3,566,714 | 3/1971 | Borello | 74/417 X |
| 3,802,002 | 4/1974 | Jonas | 108/147 X |

*Primary Examiner*—Roy D. Frazier
*Assistant Examiner*—Peter A. Aschenbrenner
*Attorney, Agent, or Firm*—Haseltine, Lake, & Waters

[57] ABSTRACT

The invention relates to a system of support legs for a table top wherein at least two legs are hingedly assembled to the table top and are connected to a driving device allowing the height of the table top to be adjusted with respect to a supporting surface, each leg comprising two arms hingedly connected at their adjacent ends to a nut screwed on a threaded rod controlled by said driving device for modifying the angular opening of said two arms with respect to one another.

2 Claims, 4 Drawing Figures

SYSTEM OF SUPPORT LEGS FOR A TABLE, A SEAT OR LIKE OBJECT RESTING UPON THE FLOOR BY MEANS OF A SET OF LEGS

The present invention relates to a system of support legs for a top, a seat or like object resting upon the floor by means of a set of legs, more particularly a system of hinged legs allowing the height of the supported surface with respect to the supporting surface to be adjusted.

Systems of articulated support legs allowing the height of, for example, a table top to be adjusted in height are already known in the prior art, such as those constituted by a telescopic central system of legs actuated by a fluid under pressure or those constituted by crossed legs with a certain number of notches allowing for a definite adjustment of the supported surface. However, the characteristic of such types of systems of legs in that the minimum table-top height which can be obtained corresponds substantially to the maximum middle-height inherent in the characteristics of the system of legs selected.

The invention is intended to eliminate this major drawback and provides a system of hinged legs allowing a minimum height of the supported surface less than the admissible maximum middleheight to be obtained.

The invention therefore has for its object a system of support legs for a table top, a seat or like object resting on the floor through the medium of a set of legs, characterized in that the said legs are hingedly assembled to the said table top, seat or the like and are connected to a driving device for rotating the said legs about their hinges and thus allowing the said table top, seat or the like to be adjusted in height with respect to the said bearing surface.

According to another feature of the invention, each leg comprises two arms hingedly connected to one another at their adjacent ends, the other end of the upper arm being hingedly connected to the said table top, seat or the like, the other end of the lower arm being hingedly connected to a lower frame resting upon the bearing surface, the common hinged joint of the two arms being connected to the driving device and causing, by its displacement, the angular opening of the two arms with respect to one another.

According to another feature of the invention, the said hinged joint comprises a nut screwed on a threaded rod, itself selectively driven in rotation by the driving device.

Figure 1:
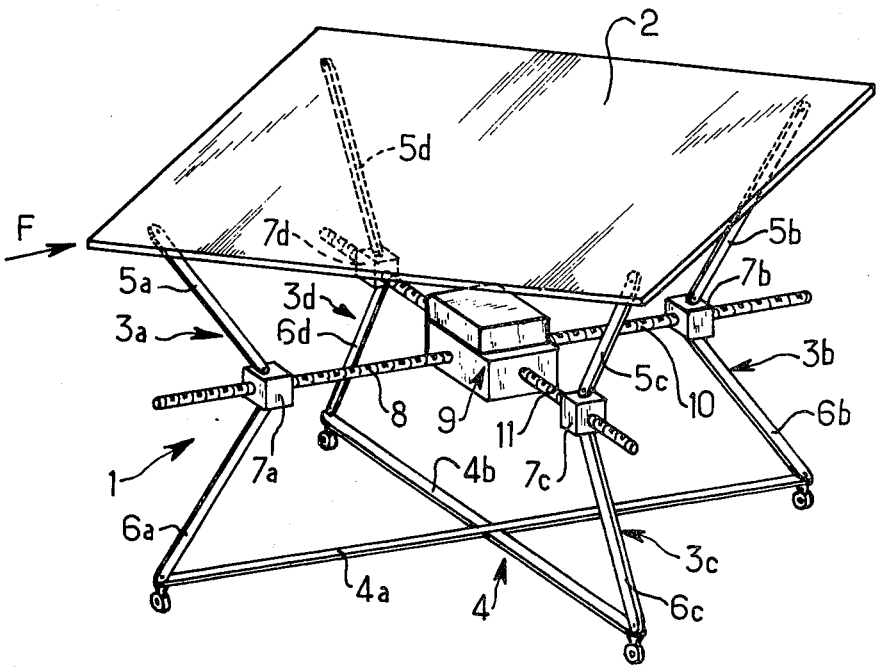
Figure 2:
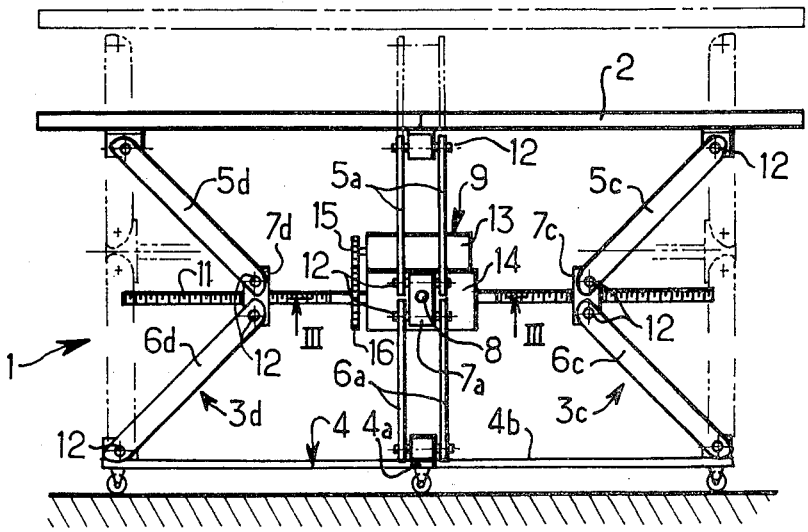
Figure 3:
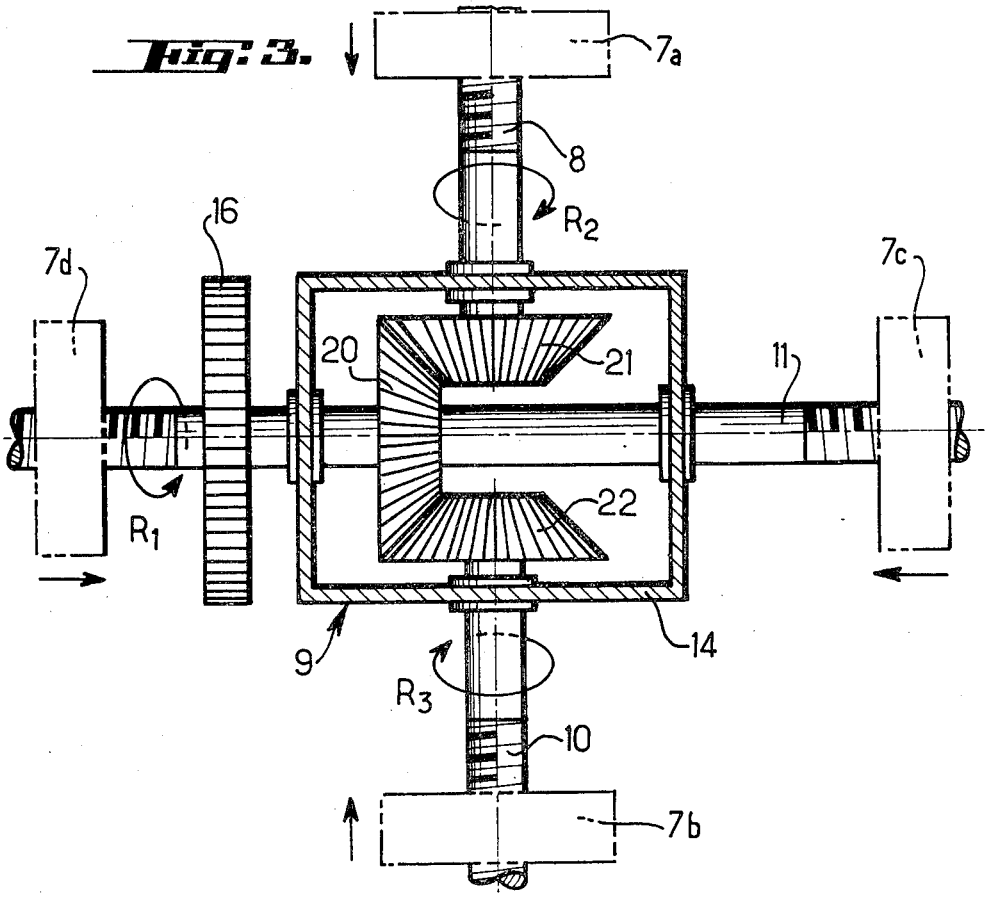
Figure 4:
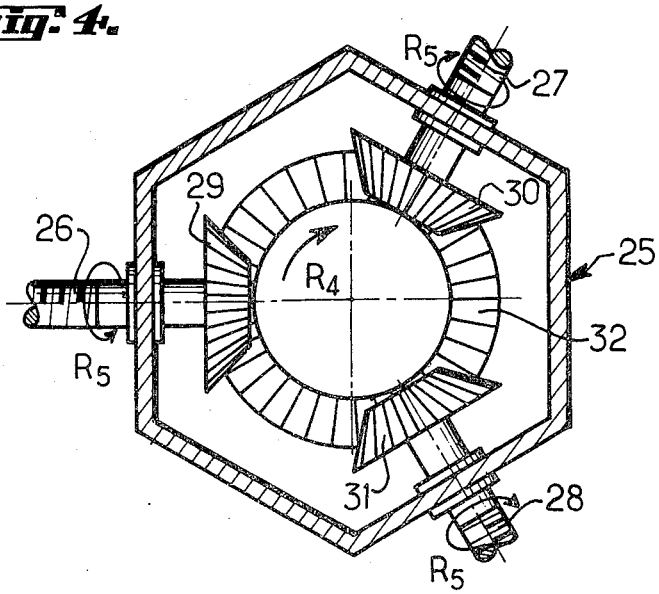

Other advantages, features and details will appear more clearly from the explanatory description made with reference to the appended drawings given solely by way of example and wherein:

FIG. 1 is a perspective view illustrating the principle of the system of support legs according to the invention, FIG. 2 is a view according to arrow F of FIG. 1, directed along a diagonal of the supported surface, FIG. 3 is an enlarged partial sectional view upon the line III—III of FIG. 2, and FIG. 4 is an enlarged partial sectional bottom-view of a second form of embodiment. The invention therefore relates to a self-raising system of support legs capable of lowering a supported surface to a height lower than the admissible maximum middle-height, by providing a system of hinged legs which is preferably actuated automatically by a driving device placed between the supported surface and the supporting surface.

Referring to FIG. 1, there is shown a basic perspective view of a system 1 of legs supporting a table top 2 through the medium of four legs 3a, 3b, 3c, 3d arranged 90° apart from one another. Each leg (3a, 3b, 3c, 3d) comprises an upper arm (5a, 5b, 5c, 5d) and a lower arm (6a, 6b, 6c, 6d) hinged to one another at their adjacent ends, the other end of the upper arm 5a, 5b, 5c, 5d) being hinged to the table top 2, the other end of the lower arm (6a, 6b, 6c, 6d) being hinged to a lower frame 4 which is, for example, cruciform and rests directly or indirectly through the medium of, for example, casters on a supporting surface such as a floor. The lower frame 4 comprises a first cross-bar 4a interconnecting the lower arms 6a and 6b of the legs 3a and 3b and a second cross-bar 4b interconnecting the two other legs 3c and 3d. The four hinged joints interconnecting the mutually adjacent ends of the two arms of the legs 3a, 3b, 3c, 3d are constituted by four nuts 7a, 7b, 7c, 7d, respectively, screwed on four coplanar threaded rods arranged 90° from one another, the adjacent ends of which are connected to a driving device 9. More specifically, to the nut 7a is associated a threaded rod 8, to the diametrically opposite nut 7b corresponds a threaded rod 10, whereas the two nuts 7c and 7d are traversed by a common threaded rod 11 which passes right through the driving device 9, as will be seen later in more detail with reference to FIG. 3.

Referring to FIG. 2, a first position of the table top 2 is shown in full lines, and a second position thereof, corresponding to the maximum height which it can reach, is shown in dashed lines. As in fact observed in this Figure, each upper and lower arm is constituted by two links which are hingedly assembled to the corresponding hinge nuts, on either side of each said nut through the medium of the two hinge pins 12 tightly fitted into the external surface of the said nut, the said links being also hingedly assembled to the underside of the table top 2 and to the lower frame 4 in a similar manner. The driving device 9 is essentially constituted by an electric motor 13 with two directions of rotation, a gear box 14, a driving gear wheel 15 driven by the motor 13, and a driven gear wheel 16 mounted on the threaded rod 11 common to both hinged joints 7c and 7d of the legs 3c and 3d.

Referring to FIG. 3, the driving device 9 allowing the table top 2 to be adjusted in height with respect to the bearing surface will now be described in more detail. The gear box 14 of the driving system 9 ensures the transmission of the rotational movement of the electric motor 13 to the threaded rods 8, 10, 11. To this end, a bevel gear carried by the threaded rod 11 meshes, on the one hand, with a right-angle transmission gear 22 carried by one end of the threaded rod 10 associated with the hinge nut 7b of the leg 3b and, on the other hand, with a second right-angle transmission gear 21 carried by one end of the threaded rod 8 associated with the hinge nut 7a of the leg 3a. The rod 11 associated towards its ends with the nuts 7c and 7d of the legs 3c and 3d carries in proximity to the gear box 14 the driven gear 16 meshing with the gear 15 driven by the motor 13 (FIG. 2).

Referring to FIG. 4, there is partially shown a second form of embodiment which relates to a system of support legs composed of three legs 120° apart from one another. The legs (not shown) are identical with those described in the first form of embodiment, the differences between the two forms of embodiment lying in the driving system 9.

The driving system in this second form of embodiment comprises an electric motor with two directions of rotation (not shown) identical with the foregoing motor, and a gear box 25 which receives the ends of three threaded rods 26, 27, 28 arranged 120° apart from one another, the other ends of the said rods penetrating into three hinge nuts (not shown) associated with the three legs of the table-top support system.

The ends of the three threaded rods 26, 27, 28 located within the gear box 25 carry three bevel gears 29, 30, 31, respectively, arranged along one and the same circumference and 120° apart from one another. These three bevel gears mesh with a right-angle transmission gear 32 driven in rotation by the electric motor (not shown).

The operation of the hinged system of support legs according to the invention will now be described with reference to the various appended Figures. Assuming that the threaded rod 11 is driven by the electric motor 13 through the medium of the driving gear 15 and the driven gear 16 in the direction of rotation indicated by arrow R1 (FIG. 3), this direction of rotation is transmitted to the gear 20 which transmits the same, on the one hand, to the gear 21 driving the threaded rod 8 in the direction of rotation indicated by arrow R2, and, on the other hand, to the gear 22 driving the threaded rod 10 in the direction of rotation indicated by arrow R3, i.e. in the opposite direction to the one indicated by arrow R2.

Since the nuts *7a, 7b, 7c, 7d* displaceable in translation must move in unison either towards the driving force 9 or in the opposite directions, it is obviously necessary that the inclinations of the threads of the threaded rods 8 and 9 be the same since they rotate in mutually opposite directions, and that the inclinations of the threads of the common threaded rod 11 be opposite to one another on either side of the driving device 9.

With the thread inclinations indicated in FIG. 3 the rotation in the direction R1 of the threaded rod 11 causes the hinge nuts *7a, 7b, 7c, 7d* to move towards one another by translation. As a result, referring to FIGS. 1, 2, the angular spacing between the upper and lower arms of each leg *3a, 3b, 3c, 3d* tends towards 0°, thus lowering the table top 2.

When the threaded rod 11 is rotated in the opposite direction, the nuts *7a, 7b, 7c, 7d* move away from another, so that the angular spacing between the upper and lower arms of each leg *3a, 3b, 3c, 3d* tends towards 180° (as indicated by dashed lines in FIG. 2), thus resulting in an ascending motion of the table top 2.

In the second form of embodiment relating to a three-leg support system, the rotation of the gear 32 indicated by arrow R4 drives in one and the same direction of rotation indicated by arrow R5 the three gears 29, 30, 31 associated with the three threaded rods 26, 27, 28, respectively, having the same thread inclination, and therefore causes the three hinge nuts (not shown) to move towards one another, thus resulting in a lowering of the table top 2. Of course the opposite direction of rotation of the gear 32 results in an ascending motion of the table top 2.

Other forms of embodiment are conceivable, in particular where the table top to be supported is relatively long. In this case, use can be made of two systems of support legs placed substantially towards the ends of the table top, with driving devices associated with the said two systems, respectively, and acting in synchronism.

Thus, a self-raising system of hinged support legs according to the invention allows a new problem to be solved, i.e. the possibility of obtaining a minimum height of the supported surface lower than the maximum middle-height which the said supported surface can reach. Moreover, the driving system of quite simple design allows the movements of the supported surface to be automated. However, a simple manual actuation by means of, for example, a crank is perfectly conceivable. In addition, the driving device is relatively small in volume, thus allowing the occupied space under the supported surface to be reduced to a minimum in order not to incommode the legs of, for example, several persons sitting round the aforesaid table top raised to its upper position.

A system of support legs according to the invention may find a great number of applications, e.g. for supporting a tabletop, a seat or like object for which it may be interesting and even necessary to be able to use them at different heights.

Of course, the invention is by no means limited to the forms of embodiment described and illustrated, which have been given by way of example only. In particular, it comprises all the means constituting technical equivalents to the means described as well as their combinations should the latter be carried out according to its gist and used within the scope of the following claims.

What is claimed is:

1. A system for supporting a surface such as a table top above the ground, through legs, said legs being hingedly assembled with respect to said surface and being connected to driving means causing said legs to rotate about their hinges, enabling vertical adjustment of the height of said support surface wherein: each leg comprises an upper and a lower arm respectively, said arms being hingedly connected to one another at adjacent ends, one end of said upper arm being hingedly connected to the said supported surface at an edge thereof, one end of the lower arm being hingedly connected to a frame resting upon the ground, and a common hinged joint of said arms of each leg being connected to the said driving means for causing, by its displacement, an angular opening of said arms with respect to one another, whereby said respective hinged joints move away from one another when said supported surface is rising, said commonhinged joint being defined by a nut screwed on a threaded rod, said threaded rod being connected to said driving means by a set of two right-angle transmission bevelpinions, one of whch rotates jointly with the threaded rod whereas, the other rotates jointly with a driving output shaft on the said driving means, said system being further defined whereby said legs are four in number disposed 90° apart from one another having two mutually opposite legs provided with a common threaded rod being driven directly by said driving means, and which carries a bevel gear meshing with two other right-angle transmission bevel gears rotating jointly with said threaded rods associated with the two other legs, respectively.

2. A system for supporting a surface such as a table top above the ground, through legs, said legs being hingedly assembled with respect to said surface and being connected to driving means causing said legs to rotate about their hinges, enabling vertical adjustment of the height of said supported surface wherein: each leg comprises an upper and a lower arm respectively, said arms being hingedly connected to one another at adjacent ends, one end of said upper arm being hingedly connected to the said supported surface at an edge thereof, on end of the lower arm being hingedly connected to a frame resting upon the ground, and a common hinged joint of said arms of each leg being connected to the said driving means for causing, by its displacement an angular opening of said arms with respect to one another, whereby said respective hinged joints move away from one another when said supported surface is rising, and common hinged joint being defined by a nut screwed on a threaded row, said threaded rod being connected to said driving means by a set of two right-angle transmission bevelpinoins, one of which rotated jointly with the threaded rod whereas, the other rotated jointly with a driving output shaft on the said driving means, said system being further defined whereby said legs are three in number disposed 120° apart, said threaded rods being provided with bevel gears arranged along one and the same circumference and driven by a right-angle transmission bevelgear rotating jointly with the driving output shaft of the said driving means.

* * * * *

UNITED STATES PATENT AND TRADEMARK OFFICE

CERTIFICATE OF CORRECTION

PATENT NO. : 4,126,096

DATED : November 21, 1978

INVENTOR(S) : MALAVARD

It is certified that error appears in the above-identified patent and that said Letters Patent are hereby corrected as shown below:

After line 7, insert the following:

--Claims priority, application France November 24, 1975, 75 35 847--

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*